US011596845B2

(12) United States Patent
Hazen

(10) Patent No.: US 11,596,845 B2
(45) Date of Patent: Mar. 7, 2023

(54) TEE-BALL BAG APPARATUS

(71) Applicant: L7 Ventures LLC, Murfreesboro, TN (US)

(72) Inventor: Jeremy Hazen, Murfreesboro, TN (US)

(73) Assignee: L7 Ventures LLC, Murfreesboro, TN (US)

( * ) Notice: Subject to any disclaimer, the term of this patent is extended or adjusted under 35 U.S.C. 154(b) by 72 days.

(21) Appl. No.: 17/134,915

(22) Filed: Dec. 28, 2020

(65) Prior Publication Data

US 2022/0203195 A1 Jun. 30, 2022

(51) Int. Cl.
*A63B 71/00* (2006.01)
*A63B 69/00* (2006.01)
*A63B 60/60* (2015.01)

(52) U.S. Cl.
CPC ..... *A63B 69/0075* (2013.01); *A63B 60/60* (2015.10); *A63B 69/0002* (2013.01); *A63B 2069/0008* (2013.01); *A63B 2214/00* (2020.08)

(58) Field of Classification Search
CPC ..... A63B 69/0075; A63B 69/0002; A63B 2069/0008; A63B 71/0045; A63B 60/60; A63B 60/56; A63B 2214/00
USPC ..... 473/422, 417; 206/315.1
See application file for complete search history.

(56) References Cited

U.S. PATENT DOCUMENTS 2,527,906 A * 10/1950 Bennett ..... A63B 69/0075 473/417
4,344,660 A * 8/1982 Molnar ..... A63B 71/0045 312/324
4,793,532 A * 12/1988 Cash ..... A45C 7/0095 206/315.1
5,046,860 A * 9/1991 Brennan ..... A45C 3/04 D34/1
5,090,614 A * 2/1992 Kupersmit ..... B65D 5/36 229/117.04
5,460,363 A * 10/1995 Tomer ..... A63B 71/0045 473/454
5,975,293 A * 11/1999 Fowler ..... A63B 60/60 206/315.9
6,009,995 A * 1/2000 Speck ..... A63B 71/0045 206/579

(Continued)

OTHER PUBLICATIONS

PCT Search Report for PCT/US2021/045569 dated Dec. 1, 2021 (11 pages).

*Primary Examiner* — Mitra Aryanpour
(74) *Attorney, Agent, or Firm* — Baker Donelson

(57) ABSTRACT

The present disclosure provides a tee-ball bag apparatus and method of use. The tee-ball bag apparatus provides users with a convenient place to storage and transport items as well as provide a tee-ball tee support with multiple pitch locations to hit a ball from. The tee-ball bag apparatus comprises a pentagonal bottom portion, a rear wall, first and second side walls, first and second forward walls, and a removable pentagonal lid coupled to an upper end of the rear wall. The rear wall, the first and second side walls, and the first and second forward walls extend vertically from the pentagonal bottom portion. The tee-ball bag apparatus further includes a plurality of vertical tee slots positioned within an interior of the bag and coupled to the rear wall. A tee-ball tee is placed within and support by one of the vertical tee slots.

18 Claims, 10 Drawing Sheets

(56) References Cited

U.S. PATENT DOCUMENTS 6,296,581 B1 * 10/2001 Sever ..... A63B 47/002 473/422
7,255,658 B1 * 8/2007 VanKuiken ..... A63B 69/0075 473/456
7,278,539 B2 * 10/2007 Souza ..... A45C 3/00 206/315.1
7,674,194 B2 * 3/2010 Lortscher ..... A63B 69/0075 473/422
7,713,752 B2 * 5/2010 Sullivan ..... G01N 33/54326 436/526
7,736,246 B2 * 6/2010 Lortscher ..... A63B 69/0002 473/422
7,771,294 B2 * 8/2010 Goucher ..... A63B 69/0002 473/425
8,257,202 B1 9/2012 Stanek
9,567,135 B1 * 2/2017 Spadaccini ..... A63B 60/60 206/315.9
9,877,558 B1 * 1/2018 Harstvedt ..... A45C 3/00
2006/0199672 A1 9/2006 Flanigan
2007/0184921 A1 * 8/2007 Smith ..... A63B 69/0079 473/453
2009/0149279 A1 * 6/2009 Fischer ..... A63B 55/60 473/417
2009/0288969 A1 11/2009 Winn
2011/0181081 A1 * 7/2011 Williams ..... A45C 9/00 2/24
2014/0343898 A1 * 11/2014 Thurman ..... A63B 71/0045 702/189
2016/0332055 A1 11/2016 Su
2017/0080311 A1 * 3/2017 Cain ..... A47C 7/622
2017/0215557 A1 8/2017 Buck
2017/0251781 A1 * 9/2017 Wilson ..... A45C 9/00
2017/0368440 A1 * 12/2017 Graham ..... B62B 1/125
2020/0283041 A1 * 9/2020 Centeno ..... A63B 71/0045
2021/0007468 A1 * 1/2021 Sutovsky ..... A45F 3/04
2022/0203195 A1 * 6/2022 Hazen ..... A63B 69/0075 473/417

* cited by examiner

TEE-BALL BAG APPARATUS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

1. Field of the Invention

The present disclosure relates generally to softball and/or baseball bags. More particularly, this disclosure pertains to softball and/or baseball equipment transportation bags.

2. Description of the Prior Art

Current softball and/or baseball bags are designed only for equipment transportation and have no functional utility beyond transportation of equipment to and from the field. Current bags are design for transporting baseballs and/or softballs, as well as other equipment, such as, baseball bats, softball bats, gloves and the like to and from the field. Additional equipment that may need to be transported to and from the field includes a batting tee, in the case of tee-ball or for general batting practice, a home plate for a pitcher to use as a reference target, laptops, note pads, and the like. Current bags do not accommodate the transportation of the above noted additional equipment.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

What is needed is a baseball and/or softball bag that allows a user to easily consolidate and transport all of the equipment needed to and from the field for baseball and/or softball practice or game play. The present disclosure provides a tee-ball bag apparatus and training tool to help consolidate everything a user may need to bring to the field. The tee-ball bag apparatus allows a user to combine a baseball/softball bucket of balls, a batting tee, a Homeplate, baseball/softball bats, gloves, notepads, additional rubber bases, and the like equipment, in an all in one easily to transport bag. The tee-ball bag apparatus further allows the user to have their own hitting station by including a plurality of internal tee slots for receiving and supporting the hitting tee.

One aspect in accordance with the embodiments disclosed herein is a tee-ball bag apparatus comprising a pentagonal bottom portion, a rear wall, first and second side walls, first and second forward walls, and a removable pentagonal lid. The rear wall may extend vertically from the pentagonal bottom portion with the rear wall including an upper end. The first and second side walls may extend vertically from the pentagonal bottom portion. The first and second side walls may be coupled to the rear wall. The first and second forward walls may be coupled together and may extend vertically from the pentagonal bottom portion. The first and second forward walls may be coupled to the first and second side walls, respectively. The pentagonal bottom portion, the rear wall, the first and second side walls, and the first and second forward walls may define a bag interior. The removable pentagonal lid may be pivotally coupled to the upper end of the rear wall. The removable pentagonal lid may include a lid perimeter and a plurality of flaps extending from the lid perimeter. Each of the plurality of flaps may be configured to be coupled to one of the first side wall, the second side wall, the first forward wall, or the second forward wall.

In certain embodiments in accordance with this aspect, the removable pentagonal lid may be coupled to the upper end of the rear wall using a zipper positioned along the upper end of the rear wall.

In other embodiments in accordance with this aspect, two of the plurality of flaps may be couplable to the first and second side walls, respectively, using a hook and loop material.

In other embodiments in accordance with this aspect, two of the plurality of flaps may be couplable to the first and second forward walls, respectively, using buckles.

In other embodiments in accordance with this aspect, the removable pentagonal lid in combination with the plurality of flaps may define a combined width of the removable pentagonal lid between 16-inches and 18-inches.

In other embodiments in accordance with this aspect, the removable pentagonal lid in combination with the plurality of flaps may be configured to be removed and placed on a ground surface for use as a Homeplate reference.

In other embodiments in accordance with this aspect, the tee-ball bag apparatus may further comprise a plurality of rigid insert panels. Each of the plurality of rigid insert panels may be positioned within one of the bottom portion, the rear wall, the first side wall, the second side wall, the first forward wall, or the second forward wall. In accordance with this aspect, at least one of the plurality of rigid insert panels may be removable.

In other embodiments in accordance with this aspect, the tee-ball bag apparatus may further comprise a plurality of vertical tee slots positioned within the bag interior and spaced along the rear wall. Each of the plurality of vertical tee slots may be configured to receive a tee-ball tee. In accordance with this aspect, each of the plurality of vertical tee slots may extend along a height of the rear wall.

In other embodiments in accordance with this aspect, the tee-ball bag apparatus may further comprise a tee storage slot coupled to an exterior surface of one of the first or second side walls. The tee storage slot may be configured to receive a tee-ball tee.

In other embodiments in accordance with this aspect, the tee-ball bag apparatus may further comprise a plurality of bat storage slots coupled to an exterior surface of one or more of the first or second side walls. In accordance with this aspect, each of the plurality of bat storage slots may include an upper tapered portion and a zipper defined along the upper tapered portion.

In other embodiments in accordance with this aspect, the tee-ball bag apparatus may further comprise a pair of backpack straps coupled between the upper end of the rear wall and a lower end of the rear wall.

One aspect in accordance with the embodiments disclosed herein is a method of using a tee-ball bag apparatus comprising (a) opening a lid of the tee-ball bag apparatus to expose an upper opening of the tee-ball bag apparatus and (b) positioning a tee-ball tee within one of a plurality of tee-ball tee slots defined within an interior of the tee-ball bag apparatus, each of the plurality of tee-ball tee slots defining a pitch location, the tee-ball tee extending above the upper opening.

In certain embodiments in accordance with this aspect, step (a) of the method may further comprise removing the lid from the tee-ball bag apparatus.

In other embodiments in accordance with this aspect, the method may further comprise positioning the lid on a ground surface to function as a to-scale Homeplate reference.

In other embodiments in accordance with this aspect, step (b) of the method may further comprise removing the tee-ball tee from an exterior slot of the tee-ball bag apparatus.

In other embodiments in accordance with this aspect, step (b) of the method may further comprise defining a first pitch location by positioning the tee-ball tee in a first slot of the plurality of tee-ball tee slots, and defining a second pitch location by positioning the tee-ball tee in a second slot of the plurality of tee-ball tee slots.

In other embodiments in accordance with this aspect, step (b) of the method may further comprise defining a third pitch location by positioning the tee-ball tee in a third slot of the plurality of tee-ball tee slots.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
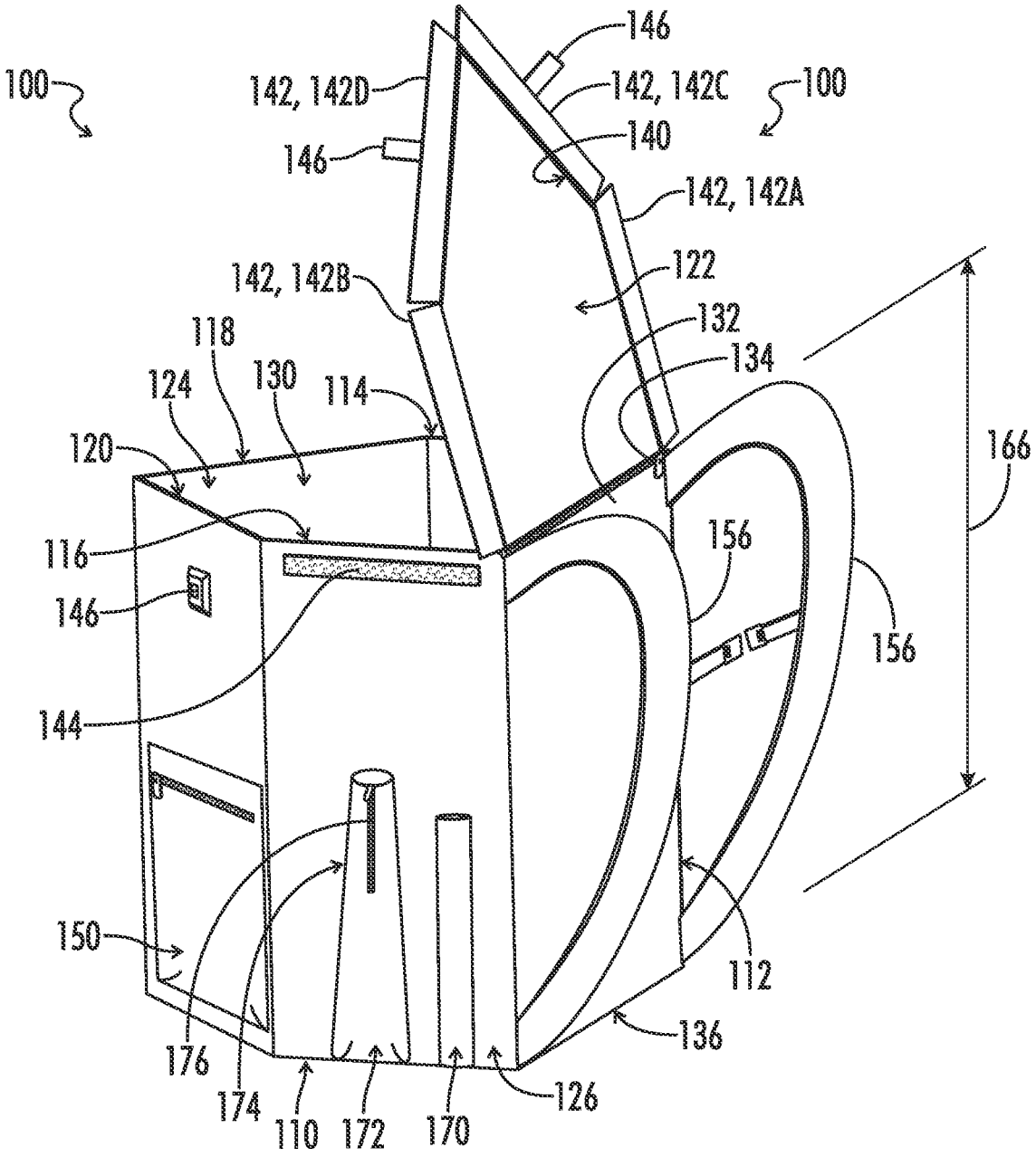
FIG. 1 is an upper rear right perspective view of a tee-ball bag apparatus in accordance with the present disclosure.
Figure 2:
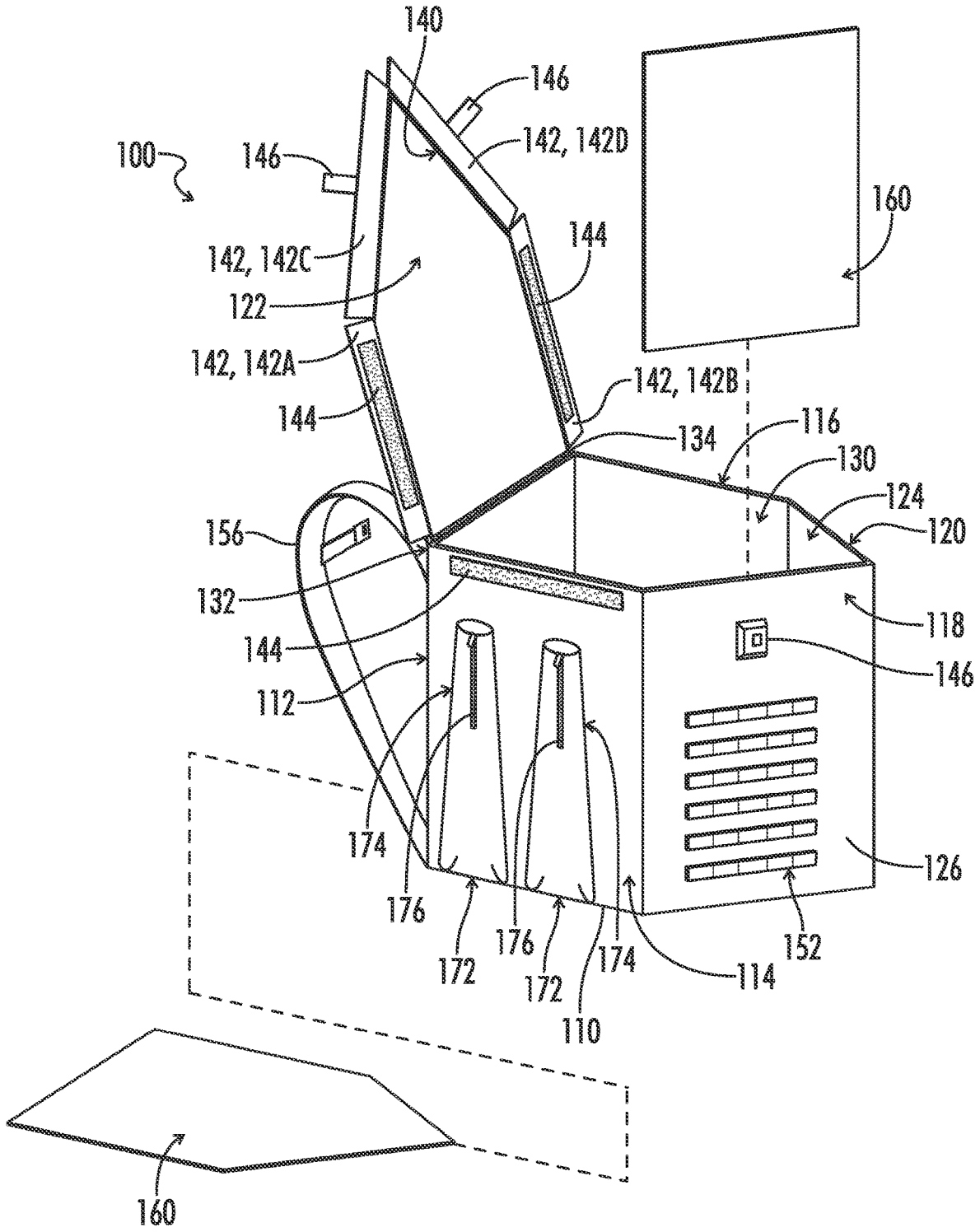
FIG. 2 is an upper front left perspective view of the tee-ball bag apparatus of FIG. 1 in accordance with the present disclosure.

Referring to FIGS. 1 and 2, a tee-ball bag apparatus 100 is shown. The tee-ball bag apparatus 100 allows a user to easily consolidate and transport all of the equipment needed to and from the field for baseball and/or softball practice or game play, as well as provide a tee-ball tee stand with multiple mounting locations. The tee-ball bag apparatus 100 comprises a pentagonal bottom portion 110, a rear wall 112, a first side wall 114, a second side wall 116, a first forward wall 118, a second forward wall 120, and a removable pentagonal lid 122. The moveable pentagonal lid 122 may also be referred to as a lid.

Upper ends of the rear wall 112, the first side wall 114, the second side wall 116, the first forward wall 118, the second forward wall 120 define an upper opening 124 of the tee-ball bag apparatus 100. The pentagonal bottom portion, the rear wall 112, the first side wall 114, the second side wall 116, the first forward wall 118, the second forward wall 120, and the removable pentagonal lid 122 define an exterior surface 126 of the tee-ball bag apparatus 100.

The rearward wall 112 is configured to extend vertically from the pentagonal bottom portion 110. The first and second side walls 114, 116 are configured to extend vertically from the pentagonal bottom portion 110 and are coupled to opposite vertically extending edges of the rear wall 112. The first and second forward walls 118, 120 are coupled together along a respective vertically extending edge of each and are configured to extend vertically from the pentagonal bottom portion 110. The first and second forward walls 118, 120 are further coupled to vertically extending edges of the first and second side walls 114, 116, respectively. The pentagonal bottom portion 110, rear wall 112, the first and second side walls 114, 116, and the first and second forward walls 118, 120 define a bag interior 130. The bag interior 130 may also be referred to herein as an interior.

The rear wall 112 includes an upper end 132. The removable pentagonal lid 122 is configured to be coupled to the upper end 132 of the rear wall. The tee-ball bag apparatus may further include a zipper 134 for coupling the removable pentagonal lid 122 to the upper end 132 of the rear wall. A first portion of the zipper 134 is positioned along the upper end 132 of the rear wall 112 and a second portion of the zipper 134 is coupled along a free edge of the removable pentagonal lid 122.

Referring to FIGS. 1-2 and 5-6, the removable pentagonal lid 122 includes a lid perimeter 140 and a plurality of flaps 142 extending from edges the lid perimeter 140 other than the free edge including the second portion of the zipper 134. Each of the plurality of flaps 142 is configured to one of the first side wall 114, the second side wall 116, the first forward wall 118, or the second forward wall 120.

First and second flaps 142A, 142B (e.g., two flaps) of the plurality of flaps 142 may be aligned with the first and second side walls 114, 116. The first and second flaps 142A, 142B are configured to be coupled to the first and second side walls 114, 116, respectively, using a hook and loop material 144. As shown in FIGS. 1 and 2, one of a hook material or a loop material of the hook and loop material 144 is coupled to an upper portion of each of the first and second side walls 114, 116. Likewise, a different one of the hook material or the loop material of the hook and loop material 144 is coupled to an underside of each of the two flaps aligned with the first and second side walls 114, 116. In other embodiments, the first and second flaps 142A, 142B may be couplable to the first and second side walls 114, 116 using a different attachment means, such as, for example buckles, releasable adhesives, slot and stud, or the like.

Third and fourth flaps 142C, 142D (e.g., two flaps) of the plurality of flaps 142 may be aligned with the first and second forward walls 118, 120. The third and fourth flaps are configured to be coupled to the first and second side walls 114, 116, respectively, using a buckle 146. As shown in FIGS. 1 and 2, one of a male buckle portion or a female buckle portion of the buckle 146 is coupled to an upper portion of each of the first and second forward walls 118, 120. Likewise, a different one of a male buckle portion or a female buckle portion of the buckle 146 is coupled to each of the two flaps aligned with the first and second forward walls 118, 120. In other embodiments, the third and fourth flaps 142C, 142D may be couplable to the first and second forward walls 118, 120 using a different attachment means, such as, for example hook and loop material, releasable adhesives, slot and stud, or the like.

Figure 10:
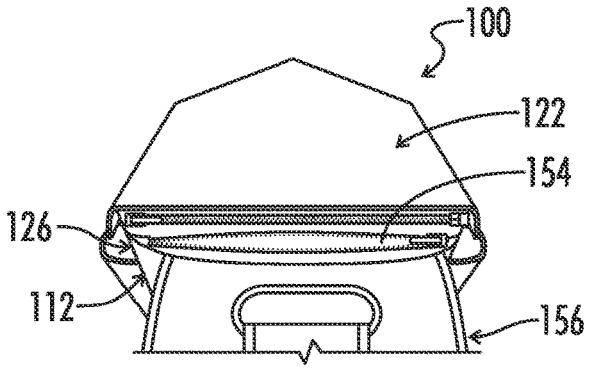
FIG. 10 is an enlarged rear upper perspective view of the tee-ball bag apparatus of FIG. 1 in accordance with the present disclosure.
Figure 13:
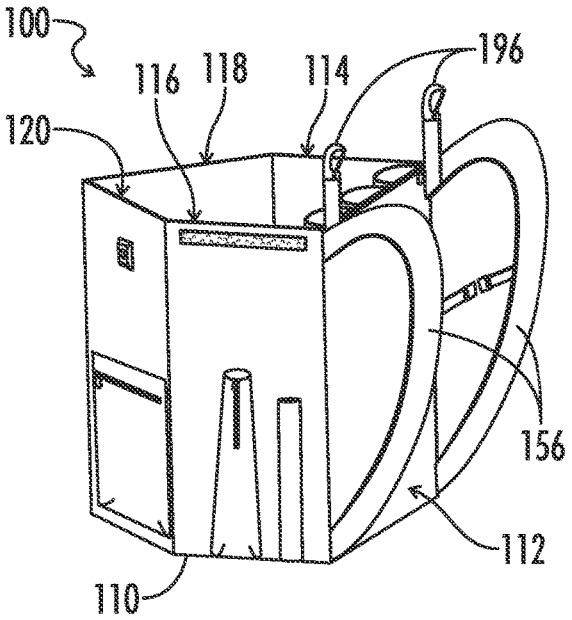
FIG. 13 is an upper rear right perspective view of the tee-ball bag apparatus of FIG. 3 with fence hooks in accordance with the present disclosure.

As shown in FIG. 1, the second forward wall 120 may include a large pocket 150 with a zippered opening connected to an exterior surface of the second forward wall 120. As shown in FIG. 2, the first forward wall 118 may include modular lightweight load-carrying equipment (MOLLE) webbing connected to an exterior surface of the first forward wall 118. In other embodiments, shown in FIG. 13, the rear wall 112 may include concealable fence attachment hooks 196 for hanging the tee-ball bag apparatus from a fence (not shown) for convenience purposes. As shown in FIG. 10, the tee-ball bag apparatus 100 may include a zippered storage pocket 154 positioned in the rear wall 112. The zippered storage pocket 154 may be accessible from an exterior of the tee-ball bag apparatus 100 along the upper end 132 of the rearward wall 112 using a zipper. The zippered storage pocket 154 may conveniently store thin rubber bases, a laptop, tablet, scorebook, and/or paperwork.

Figure 12:
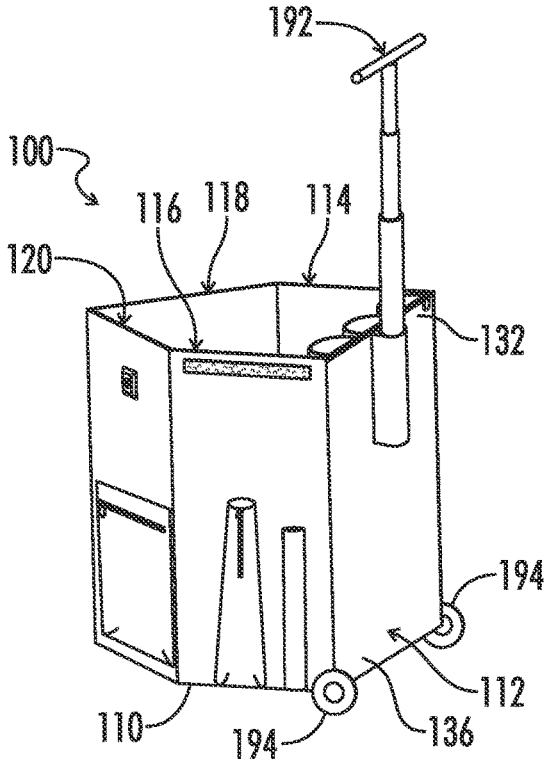
FIG. 12 is an upper rear right perspective view of the tee-ball bag apparatus of FIG. 3 with wheels and a baggage handle in accordance with the present disclosure.

The tee-ball bag apparatus 100 further includes a pair of backpack straps 156 coupled between the upper end 132 of the rear wall 112 and a lower end 136 of the rear wall 112. Alternatively, as shown in FIG. 12, the tee-ball bag apparatus 100 may include a telescopic luggage handle 192 extendable vertically from the upper end 132 of the rear wall 112 and wheels 194 coupled along the lower end 136 of the rear wall 112.

Figure 11:
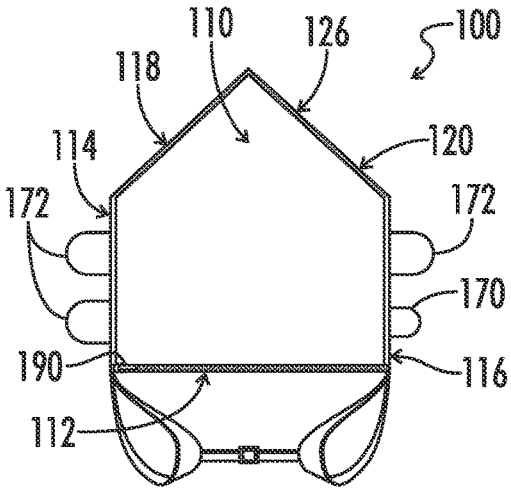
FIG. 11 is a lower perspective view of the tee-ball bag apparatus of FIG. 1 in accordance with the present disclosure.

The tee-ball bag apparatus 100 further includes a plurality of rigid insert panels 160. Each of the plurality of rigid insert panels 160 may positioned within one of the pentagonal bottom portion 110, the rear wall 112, the first side wall 114, the second side wall 116, the first forward wall 118, or the second forward wall 120. The slots within which the plurality of rigid insert panels 160 may include a padded layer (not shown) sewn therein. In certain optional embodiments, the removable pentagonal lid 122 may include a rigid insert panel positioned therein. At least one of the plurality of rigid insert panels 160 is removable in order to reduce the cost of shipping the tee-ball bag apparatus 100. As shown in FIG. 2, the rigid insert panels associated with the pentagonal bottom portion 110 and the first forward wall 118 are shown exploded from the tee-ball bag apparatus 100. As shown in FIG. 11, the rigid insert panel positioned within the pentagonal bottom portion 110 may be accessed from the exterior surface 126 along the lower end 136 of the rear wall 112 using a zipper 190. The rigid insert panel positioned within the first forward wall 118 may be accessed from the bag interior 130 using a flap (not shown) held closed using a hook and loop material. In other optional embodiments, rigid insert panel associated with the second forward wall 120 may be removable.

Figure 3:
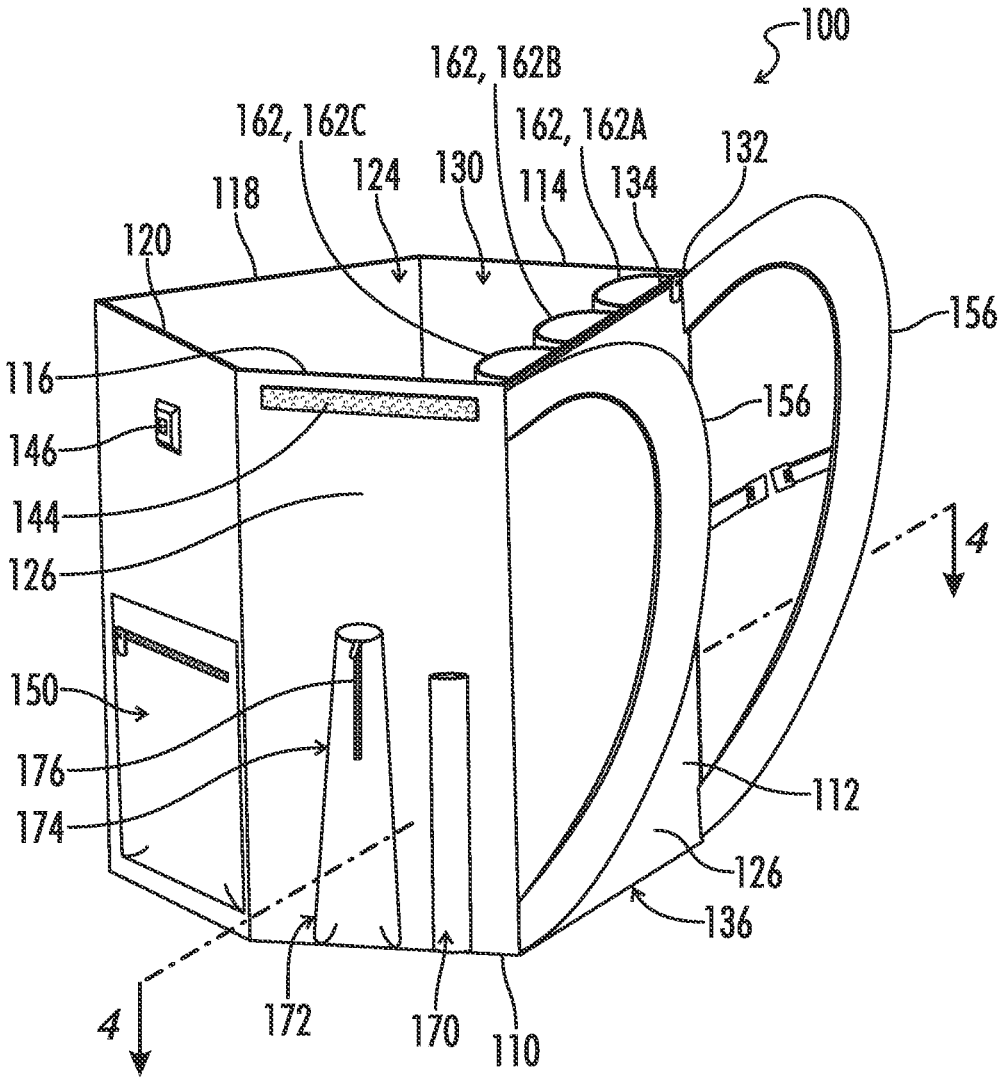
FIG. 3 is an upper rear right perspective view of the tee-ball bag apparatus of FIG. 1 with a pentagonal Homeplate shaped lid of the tee-ball bag apparatus removed in accordance with the present disclosure.
Figure 4:
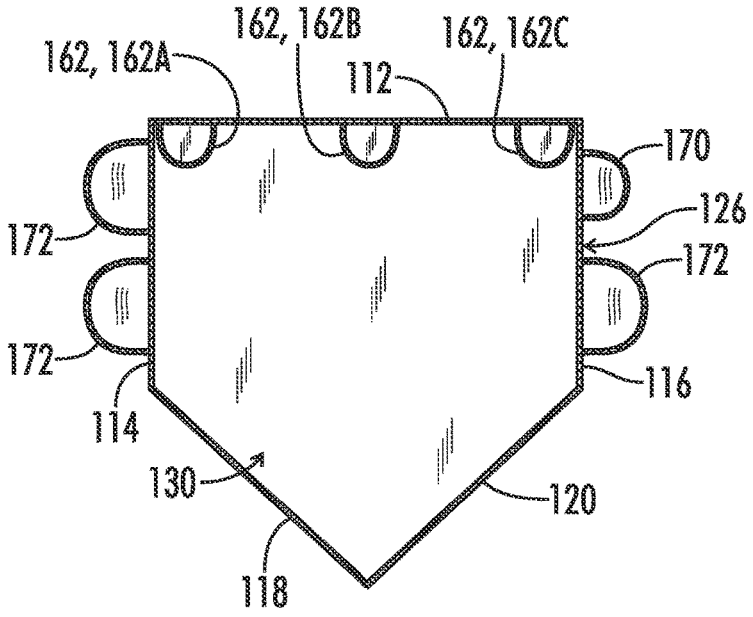
FIG. 4 is a cross-sectional top plan view of the tee-ball bag apparatus taken along line 4-4 of FIG. 3 in accordance with the present disclosure.
Figure 7:
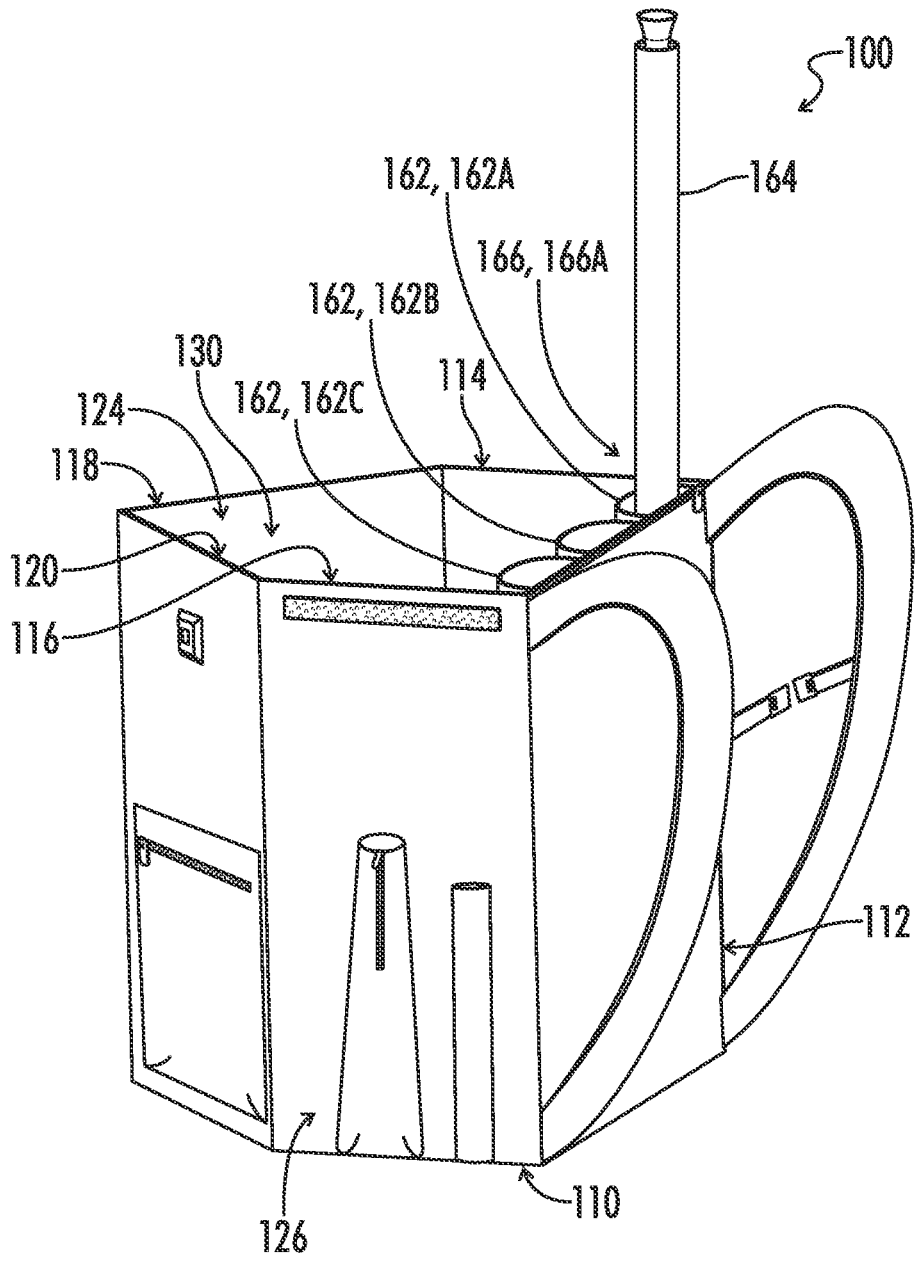
FIG. 7 is an upper rear right perspective view of the tee-ball bag apparatus of FIG. 3 with a hitting tee positioned in a first internal slot of a plurality of internal tee slots of the tee-ball bag apparatus in accordance with the present disclosure.
Figure 8:
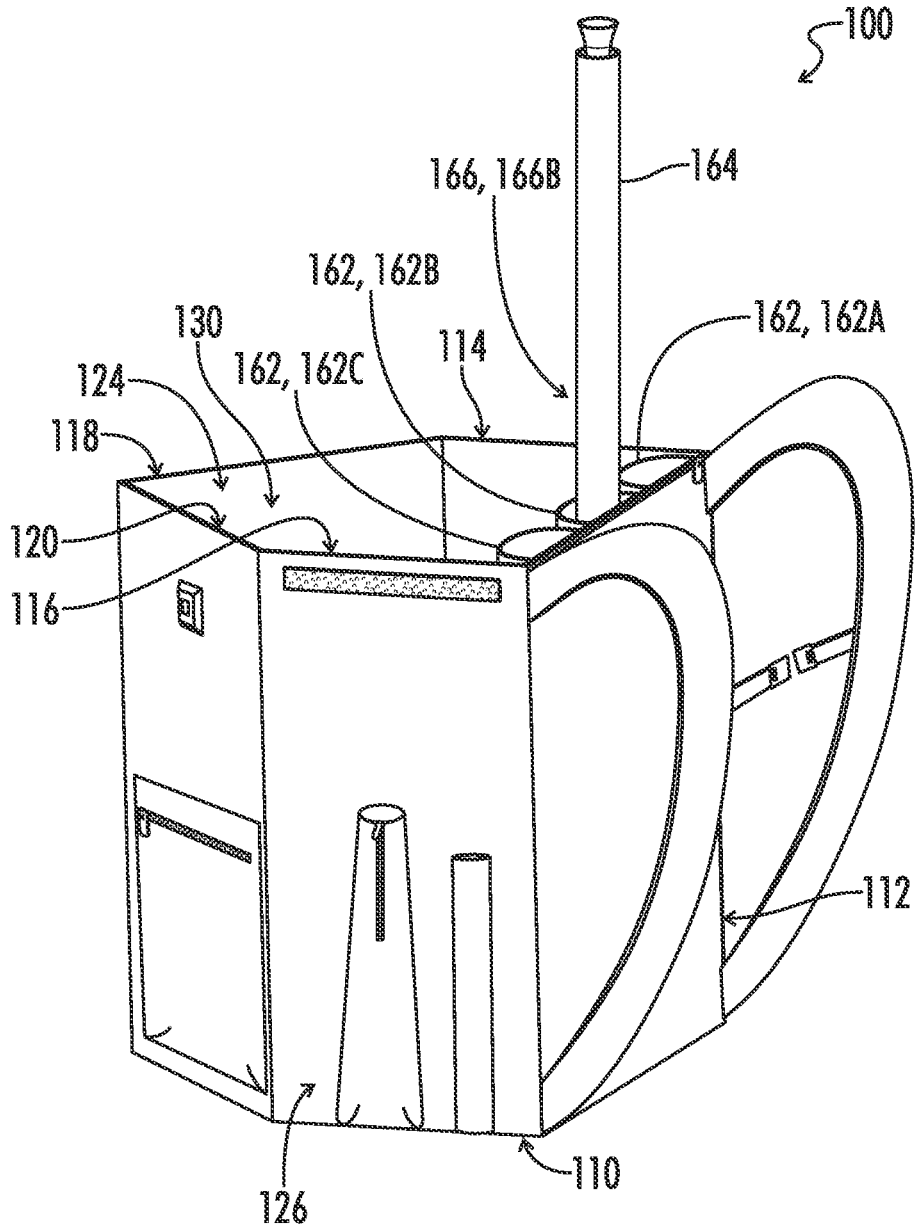
FIG. 8 is an upper rear right perspective view of the tee-ball bag apparatus of FIG. 7 with the hitting tee positioned in a second internal slot of the plurality of internal tee slots of the tee-ball bag apparatus in accordance with the present disclosure.
Figure 9:
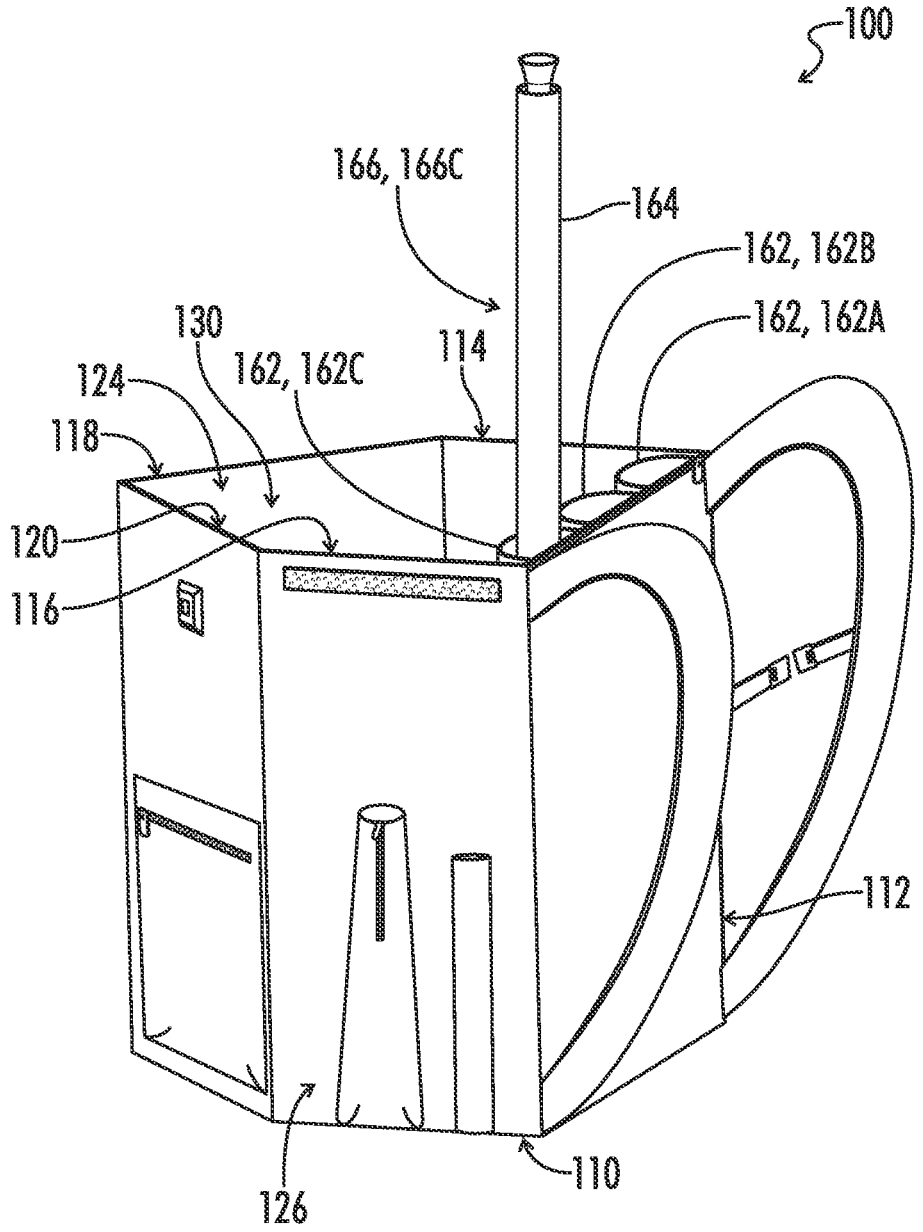
FIG. 9 is an upper rear right perspective view of the tee-ball bag apparatus of FIG. 7 with the hitting tee positioned in a third internal slot of the plurality of internal tee slots of the tee-ball bag apparatus in accordance with the present disclosure.

As shown in FIGS. 2-4, the tee-ball bag apparatus 100 may further include a plurality of vertical tee slots 162 positioned within the bag interior 130. The plurality of vertical tee slots 162 may also be referred to herein as a plurality of tee-ball tee slots. The plurality of vertical tee slots 162 may be spaced along the rear wall 112. The remained to the bag interior 130 may be used for storing baseballs, softballs, batting gloves, baseball gloves, softball gloves, a helmet, cleats, shoes, clothing, or the like. Each of the plurality of tee slots 162 is configured to receive a tee-ball tee 164, as shown in FIGS. 7-9. Each of the plurality of tee slots 162 may extend along a height 166 of the rear wall 112. The height 166 of the rear wall 112 is defined between the pentagonal bottom portion 110 and the upper opening 124 of the tee-ball bag apparatus 100. By spanning the height 166 of the rear wall 112, each of the plurality of tee slots provides support for the tee-ball tee 164 to withstand the force of hitting a ball (not shown) off of the tee-ball tee 164. The plurality of rigid insert panels 160 to help make the tee-ball bag apparatus 100 more sturdy for supporting a tee-ball tee and withstanding the force of hitting a ball off of the tee-ball tee 164. In certain optional embodiments (not shown), the plurality of vertical tee slots 162 may be positioned along any one of or combination of the rear wall 112, the first side wall 114, the second side wall 116, the first forward wall 118, the second forward wall 120, and extend along a height thereof. In other words, using the rear wall 112 as a reference, the plurality of vertical tee slots 162 may be spaced apart relative to the rear wall 112.

As shown in FIGS. 7-9, each of the plurality of vertical tee slots 162 defines a pitch location 166. As shown in FIG. 7, the tee-ball tee 164 is positioned in a first tee slot 162A of the plurality of vertical tee slots 162 to define a first pitch location 166A. As shown in FIG. 8, the tee-ball tee 162 is positioned in a second tee slot 162B of the plurality of vertical tee slots 162 to define a second pitch location 166B. As shown in FIG. 9, the tee-ball tee 162 is positioned in a third tee slot 162C of the plurality of vertical tee slots 162 to define a third pitch location 166C.

As shown in FIGS. 1-4, and 7-9, the tee-ball bag apparatus 100 may include a tee storage slot 170 coupled to the exterior surface 126 of one of the first or second side walls 114, 116. The tee storage slot 170 may also be referred to herein as an exterior slot. The tee storage slot 170 is configured to receive the tee-ball tee 164, for example, any standard rubber tee and/or newer aluminum tee. The tee-ball bag apparatus 100 may further include a plurality of bat storage slots 172 coupled to the exterior surface 126 of one of the first or second side walls 114, 116. Each of the plurality of bat storage slots 172 is configured to receive a bat (not shown), for example, a baseball or softball bat or any size. The tee storage slot 170 and the plurality of bat storage slots 172 may be formed from a neoprene material or any other stretchy durable material. Each of the plurality of bat storage slots 172 includes an upper tapered portion 174 for assisting holding a bat vertically while stored and a zipper 176 defined along the upper tapered portion 174. The zipper 176 is configured to widen an opening of the upper tapered portion 174 for inserting the bat.

Figure 5:
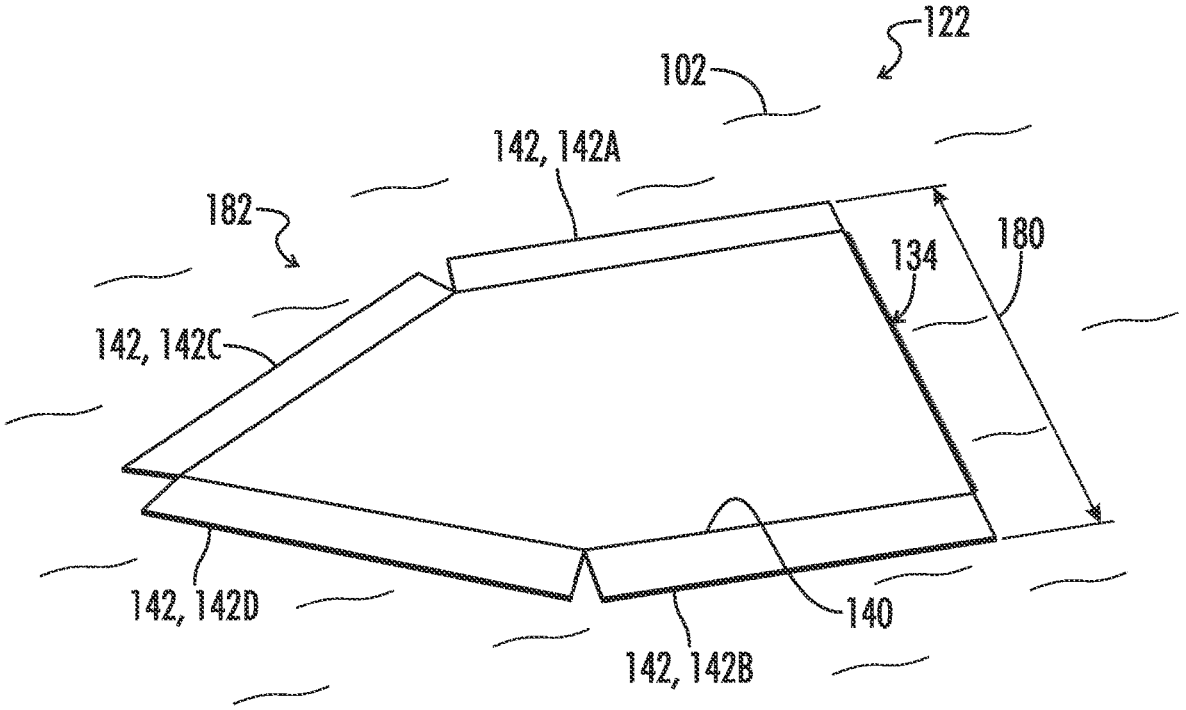
FIG. 5 is an upper front right perspective view of pentagonal Homeplate shaped lid of FIG. 1 removed from the tee-ball bag apparatus and laid flat in accordance with the present disclosure.
Figure 6:
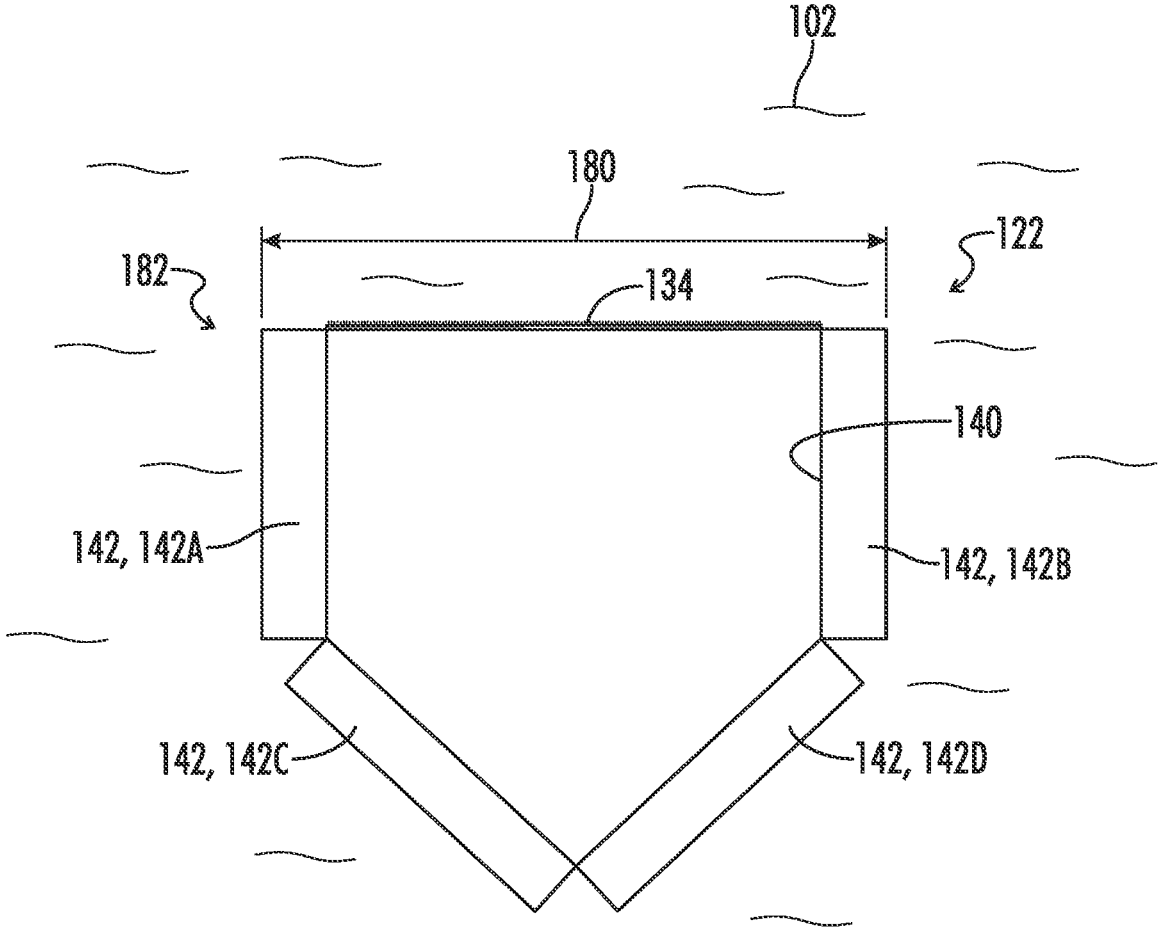
FIG. 6 is a top plan view of the pentagonal Homeplate shaped lid of FIG. 5 in accordance with the present disclosure.

As shown in FIGS. 5 and 6, the removable pentagonal lid 122 in combination with the first and second flaps 142A, 142B of the plurality of flaps 142 defines a combined width 180 of the removable pentagonal lid 122 between 16 inches and 18 inches. In certain optional embodiments, the combined width 180 may be 17 inches, the same width as a standard Homeplate. Each of the first and second flaps 142A, 142B may have a width of 2 inches while the middle portion of the removable pentagonal lid 122 has a width of 13 inches.

The removable pentagonal lid 122 in combination with the plurality of flaps 142 is configured to be removed from the tee-ball bag apparatus 100 and placed on a ground surface 102 for use as a to-scale Homeplate reference 182. The removable pentagonal lid 122 in combination with the plurality of flaps 142 may be the same size dimensionally as a standard Homeplate, except it is missing connections between the plurality of flaps 142 (e.g., where the cutouts are located).

The rear wall 112, the first and second side walls 114, 116, and the first and second forward walls 118, 120 defining a portion of the exterior surface 126 may be made from a durable ply 1680D/PVC fabric material or the like. The pentagonal bottom portion 110 and the removable pentagonal lid 122 may be externally and/or interially covered with a 0.55 mm PVC tarpaulin waterproof material or the like.

Figure 14:
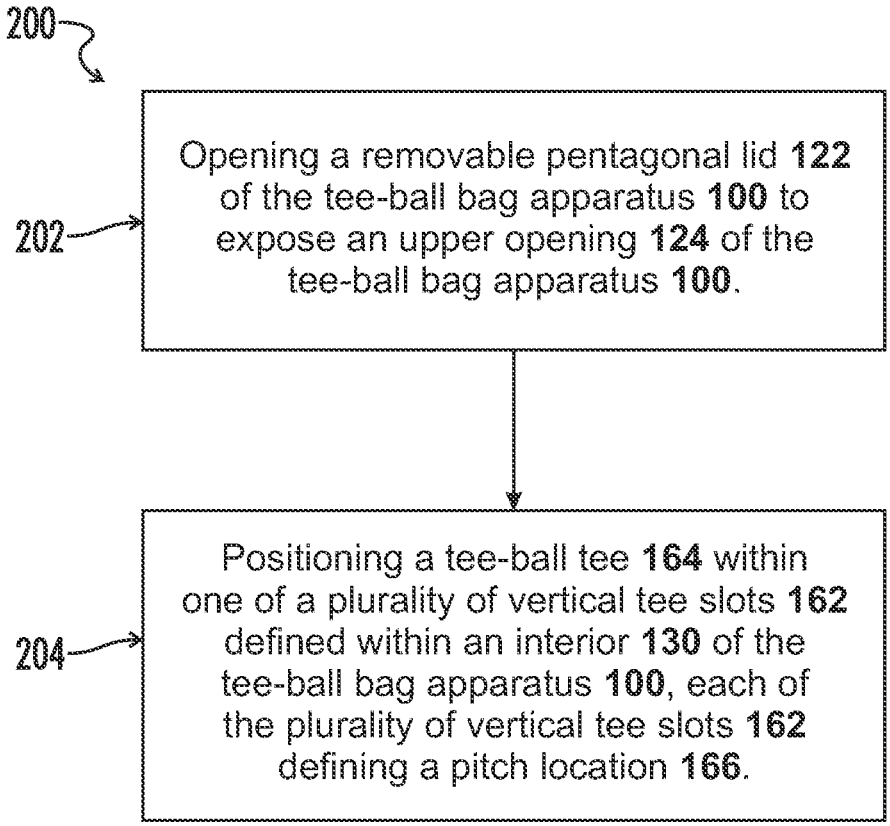
FIG. 14 is a flowchart of a method of using the tee-ball bag apparatus of FIG. 1 in accordance with the present disclosure.

Referring to FIG. 14, a method 200 of using the tee-ball bag apparatus 100 is provided herein. The method 200 comprises step (a) opening 202 a removable pentagonal lid 122 of the tee-ball bag apparatus 100 to expose an upper opening 124 of the tee-ball bag apparatus 100, and step (b) positioning 204 a tee-ball tee 164 within one of a plurality of vertical tee slots 162 defined within an interior 130 of the tee-ball bag apparatus 100, each of the plurality of vertical tee slots 162 defining a pitch location 166. The tee-ball tee 164 is configured to extend above the upper opening 124.

Step (a) of the method 200 may further include removing the removable pentagonal lid 122 from the tee-ball bag apparatus 100.

The method 200 may further include positioning the removable pentagonal lid 122 on a ground surface 102 to function as a to-scale Homeplate reference 182.

Step (b) of the method 200 may further include removing the tee-ball tee 164 from a tee storage slot 170 of the tee-ball bag apparatus 100.

Step (b) of the method 200 may further include defining a first pitch location 166A by positioning the tee-ball tee 164 in a first slot 162A of the plurality of vertical tee slots 162, and defining a second pitch location 166B by positioning the tee-ball tee 164 in a second slot 162B of the plurality of vertical tee slots 162.

Step (b) of the method 200 may still further include defining a third pitch location 166C by positioning the tee-ball tee 164 in a third slot 162C of the plurality of vertical tee slots 162.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful TEE-BALL BAG APPARATUS and method of use, it is not intended that such references be construed as limitations upon the scope of this disclosure except as set forth in the following claims

What is claimed is:

1. A tee-ball bag apparatus comprising:

a pentagonal bottom portion;

a rear wall extending vertically from the pentagonal bottom portion, the rear wall including an upper end;

first and second side walls extending vertically from the pentagonal bottom portion, the first and second side walls coupled to the rear wall;

first and second forward walls coupled together and extending vertically from the pentagonal bottom portion, the first and second forward walls coupled to the first and second side walls, respectively, the pentagonal bottom portion, the rear wall, the first and second side walls, and the first and second forward walls defining a bag interior;

a plurality of vertical tee slots positioned within the bag interior, the plurality of vertical tee slots coupled to and spaced along the rear wall, each of the plurality of vertical tee slots configured to receive a tee-ball tee corresponding to a different pitch location; and a removable pentagonal lid pivotally coupled to the upper end of the rear wall, the removable pentagonal lid including a lid perimeter and a plurality of flaps hingedly coupled to and extending from the lid perimeter, each of the plurality of flaps configured to be coupled to one of the first side wall, the second side wall, the first forward wall, or the second forward wall.

2. The tee-ball bag apparatus of claim 1, wherein:

the removable pentagonal lid is coupled to the upper end of the rear wall using a zipper positioned along the upper end of the rear wall.

3. The tee-ball bag apparatus of claim 1, wherein:

two of the plurality of flaps are couplable to the first and second side walls, respectively, using a hook and loop material.

4. The tee-ball bag apparatus of claim 1, wherein:

two of the plurality of flaps are couplable to the first and second forward walls, respectively, using buckles.

5. The tee-ball bag apparatus of claim 1, wherein:

the removable pentagonal lid in combination with the plurality of flaps hinged to be planar defines a combined width of the removable pentagonal lid between 16-inches and 18-inches.

6. The tee-ball bag apparatus of claim 1, wherein:

the removable pentagonal lid in combination with the plurality of flaps is configured to be removed and placed on a ground surface for use as a Homeplate reference.

7. The tee-ball bag apparatus of claim 1, further comprising:

a plurality of rigid insert panels, each of the plurality of rigid insert panels positioned within one of the bottom portion, the rear wall, the first side wall, the second side wall, the first forward wall, or the second forward wall.

8. The tee-ball bag apparatus of claim 7, wherein:

at least one of the plurality of rigid insert panels is removable.

9. The tee-ball bag apparatus of claim 1, wherein:

each of the plurality of vertical tee slots extends along a height of the rear wall.

10. The tee-ball bag apparatus of claim 1, further comprising:

a tee storage slot coupled to an exterior surface of one of the first or second side walls, the tee storage slot configured to receive a tee-ball tee.

11. The tee-ball bag apparatus of claim 1, further comprising:

a plurality of bat storage slots coupled to an exterior surface of one or more of the first or second side walls.

12. The tee-ball bag apparatus of claim 11, wherein:

each of the plurality of bat storage slots includes an upper tapered portion and a zipper defined along the upper tapered portion.

13. The tee-ball bag apparatus of claim 1, further comprising:

a pair of backpack straps coupled between the upper end of the rear wall and a lower end of the rear wall.

14. The tee-ball bag apparatus of claim 1, wherein:

the plurality of vertical tee slots is configured to define at least two pitch locations when the tee-ball tee is positioned in different ones of the plurality of vertical tee slots.

15. The tee-ball bag apparatus of claim 1, wherein:

the plurality of vertical tee slots includes a first tee slot associated with a first pitch location when the tee-ball tee is received by the first tee slot.

16. The tee-ball bag apparatus of claim 15, wherein:

the plurality of vertical tee slots includes a second tee slot spaced apart from the first tee slot along the rear wall; and the second tee slot is associated with a second pitch location when the tee-ball tee is received by the second tee slot.

17. The tee-ball bag apparatus of claim 16, wherein:

the plurality of vertical tee slots includes a third tee slot spaced apart from the first and second tee slots along the rear wall; and the third tee slot is associated with a third pitch location when the tee-ball tee is received by the third tee slot.

18. The tee-ball bag apparatus of claim 1, wherein:

each of the pentagonal bottom portion, the rear wall, the first and second side walls, and the first and second forward walls are formed from a fabric material.

* * * * *